US008963424B1

(12) United States Patent
Neilson

(10) Patent No.: US 8,963,424 B1
(45) Date of Patent: Feb. 24, 2015

(54) COUPLER FOR COUPLING GYROTRON WHISPERING GALLERY MODE RF INTO HE11 WAVEGUIDE

(75) Inventor: Jeffrey M. Neilson, Redwood City, CA (US)

(73) Assignee: Calabazas Creek Research, Inc., San Mateo, CA (US)

( * ) Notice: Subject to any disclaimer, the term of this patent is extended or adjusted under 35 U.S.C. 154(b) by 647 days.

(21) Appl. No.: 13/016,995

(22) Filed: Jan. 29, 2011

(51) Int. Cl.
*H01J 23/40* (2006.01)

(52) U.S. Cl.
CPC ..... *H01J 23/40* (2013.01)
USPC ..... 315/5; 333/21 R; 333/252

(58) Field of Classification Search
CPC ..... H01J 23/40
USPC ..... 333/21 R, 252; 315/4, 5, 5.24, 5.29, 315/5.31; 331/79, 80
See application file for complete search history.

(56) References Cited

U.S. PATENT DOCUMENTS 5,015,914 A 5/1991 Ives et al.
5,030,929 A * 7/1991 Moeller ..... 333/21 R
5,187,409 A 2/1993 Ito
5,266,868 A 11/1993 Sakamoto
5,266,962 A * 11/1993 Mobius et al. ..... 343/781 R
5,652,554 A * 7/1997 Krieg et al. ..... 333/21 R
5,719,470 A 2/1998 Hirata et al.
6,476,558 B2 11/2002 Sakamoto

OTHER PUBLICATIONS

Denisov et al, "110 Ghz gyrotron with a built-in high efficiency converter", Int J. Electronics, 1992, vol. 72, Nos. 5-6, 1079-1091.
Lorbeck, "A shaped-reflector high-power converter for a whispering gallery mode gyrotron output", IEEE Transactions on Antennas and Propagation, vol. 43 No. 12, Dec. 1995.
Oda et al, "Gyrotron Beam Coupling Method into Corrugated Waveguide", 2009.
Neilson, "Surface Integral Equation Analysis of Quasi-Optical Launchers", IEEE Transactions on Plasma Science, vol. 30, No. 3, Jun. 2002.
Neilson, "Optimization of Quasi-Optical Launchers for Multifrequency Gyrotrons" IEEE Transactions in Plasma Science, vol. 35, No. 6, Dec. 2007.

* cited by examiner

*Primary Examiner* — Benny Lee
(74) *Attorney, Agent, or Firm* — File-EE-Patents.com; Jay A. Chesavage

(57) ABSTRACT

A cylindrical waveguide with a mode converter transforms a whispering gallery mode from a gyrotron cylindrical waveguide with a helical cut launch edge to a quasi-Gaussian beam suitable for conveyance through a corrugated waveguide. This quasi-Gaussian beam is radiated away from the waveguide using a spiral cut launch edge, which is in close proximity to a first mode converting reflector. The first mode converting reflector is coupled to a second mode converting reflector which provides an output free-space HE11 mode wave suitable for direct coupling into a corrugated waveguide. The radiated beam produced at the output of the second mode converting reflector is substantially circular.

19 Claims, 4 Drawing Sheets

Prior Art Gyrotron

Section B–B

Section A–A

200
Gyrotron Launch Coupler

Section C–C

Section D–D

Section D–D

Gyrotron Launch Coupler

Section E–E

Section D–D

COUPLER FOR COUPLING GYROTRON WHISPERING GALLERY MODE RF INTO HE11 WAVEGUIDE

The present invention was developed with the U.S. Department of Energy under grant DE-FG02-05ER84181. The government has certain rights in this invention.

FIELD OF THE INVENTION

The present invention relates to an RF mode converter and coupler for a gyrotron. In particular, the present invention relates to an apparatus and method for coupling the RF power generated in a gyrotron cavity and traveling as whispering gallery (WG) mode in a cylindrical waveguide to the HE11 mode. In one example, WG mode is coupled from a circular waveguide to a first and second reflector for direct coupling to a corrugated waveguide.

BACKGROUND OF THE INVENTION

Modern high power gyrotrons produce power in high-order TE modes ($TE_{mn}$ modes with m,n>>1). These modes cannot be efficiently transported as RF (radio frequency) power in a low loss transmission system. In addition, it is advantageous to separate the RF transmission from that of the spent electron beam within the gyrotron. Both of these considerations are typically addressed using an internal mode converter and step-cut launcher, which is commonly referred to as a quasi-optical (QO) launcher. The mode converter has small deformations in the waveguide surface to transform the high-order cavity mode into a set of modes whose combined fields have a Gaussian-like profile. The Gaussian-like beam can then be efficiently launched, focused, and guided by mirrors inside the vacuum envelope of the gyrotron. In this way, the RF power is converted to a mode more suitable for low loss transmission, and the RF beam is separated from the electron beam. This allows implementation of a depressed collector with large surfaces for thermal dissipation without affecting the quality of the RF beam.

This method has been the primary technique for RF-electron beam separation in high power gyrotrons since the early 1990s. The development of this technique was one of the key technologies enabling the development of mega-watt (MW) level gyrotrons. One drawback of this approach is the internal mirrors must be adjustable for optimum performance to prevent device overheating from internal losses at the high power levels. Additionally, since these large mirrors are external to the gyrotron cavity, the RF power must be coupled out of the gyrotron through a large aperture, which is typically fabricated from expensive materials such as diamond which have the desired low RF loss and high thermal conductivity required. There are several deficiencies in this technique including internal diffraction losses, electron beam potential depression, and mirror alignment issues.

It is desired to provide a mode converting device which converts high order WG modes travelling helically in a cylindrical waveguide into HE11 mode for coupling into a corrugated waveguide inside the gyrotron, thereby greatly reducing the deficiencies of the prior art approaches. In addition, substantial cost savings can be realized by eliminating the need for the two to three adjustable mirrors in the gyrotron and the external mirror optical unit used to couple the output Gaussian beam to the corrugated waveguide transmission line. A final cost savings would be realized by the large reduction in the required diameter of the diamond material in the output window.

OBJECTS OF THE INVENTION

A first object of this invention is a launcher for a gyrotron having an integrated mode converting first reflector coupled to a quasi-optical launcher comprising a cylindrical waveguide supporting Whispering Gallery (WG mode or WGM) and having a step cut launcher with a launch edge, the first reflector generating RF with an elliptical radiation pattern and coupling the RF into a second mode converting reflector generating free space wave for coupling into a corrugated waveguide where it propagates in an HE11 mode.

A second object of this invention is a gyrotron having a Whispering Gallery (WG) mode waveguide with a step-cut launcher, the step-cut launcher having a launch edge and coupling into a mode converting first reflector on the order of a wavelength from the step-cut launcher and launch edge, the first reflector generating RF with an elliptical radiation pattern and coupling this RF into a second mode converting reflector generating an HE11 wave for coupling into a waveguide.

SUMMARY OF THE INVENTION

The present invention is a launch coupler for a gyrotron having helically propagating energy contained by a cylindrical waveguide which terminates into a step-cut launcher having a launch edge, the RF energy propagating helically in a whispering gallery (WG) mode down the axis of a cylindrical waveguide. RF energy from the launch edge is coupled to a first mode converting reflector which is in close proximity to the launch edge, and thereafter to a second mode converting reflector which directs the propagating RF onto a path which may be parallel to the central axis, where the first mode converting reflector and second mode converting reflector have surfaces selected such that the RF energy which leaves the second mode converting reflector is substantially coupled into the entrance of a corrugated waveguide, after which the RF energy propagates in HE11 mode and may be subject to a variety of standard HE11 waveguide direction changing reflectors. In one example of the invention, the inner surface of the input cylindrical waveguide has depressions in the direction of wave propagation and also depressions perpendicular to the direction of wave propagation for enhanced generation of high order modes which interact with the first mode converting reflector and second mode converting reflector to generate a quasi-Gaussian intensity profile at the entrance of the corrugated waveguide. The quasi-Gaussian profile is not a pure first order Gaussian function in intensity distribution, but has the approximate characteristics of a Gaussian intensity distribution which is created through the introduction of high order modes in the waveguide 220 and mode changing reflectors 240 and 250 of FIG. 2A. In one embodiment of the invention, the first mode changing reflector is located within 0.25 to 4 wavelengths of the launch edge of the cylindrical waveguide, such that RF energy reflected from the first mode changing reflector has an amplitude profile with a substantially elliptical radiation pattern, and the shape of the second mode changing reflector is selected to convert the incident elliptical radiation amplitude profile into a circularly symmetric free space wave with a beam waist which is narrow enough to efficiently couple into a corrugated waveguide which is optimized for propagation of an HE11 mode.

BRIEF DESCRIPTION OF THE DRAWINGS

FIG. 2A shows a cross section view of a gyrotron launch coupler.

FIG. 2B shows a cross section view of FIG. 2A.

FIG. 2C shows a waveguide of FIG. 2A cut open and rolled flat.

FIG. 2D shows a cross section view of FIG. 2A.

FIG. 2D-1 shows a cross section view of FIG. 2A showing a different embodiment for a first mode changing reflector.

FIGS. 2G-1 and 2G-2 show the beam profiles through the y' and x' axis, respectively, of FIG. 2E.

DETAILED DESCRIPTION OF THE INVENTION

Figures 1A, 1B, 1C:
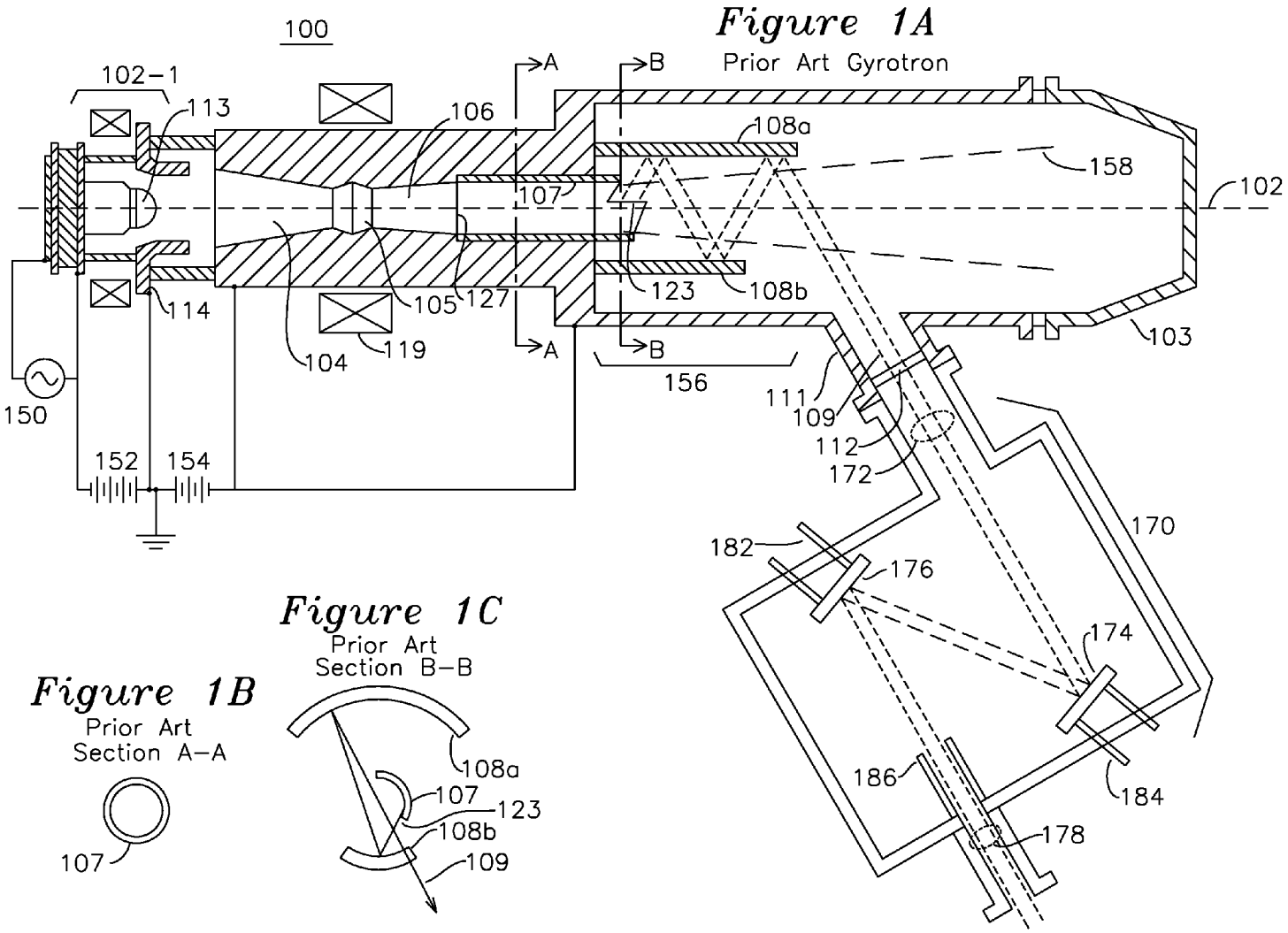
Figure 1C Prior Art
Figure 1B Prior Art
FIG. 1A shows a cross section view of a prior art gyrotron coupled to a mirror optical unit for generation of HE11.
FIG. 1B shows a cross section view of prior art FIG. 1A.
FIG. 1C shows a cross section view of prior art FIG. 1A.

The various figures and views of the invention identify each structure with a reference numeral which is understood to indicate the same structure in other figures or views. Additionally, certain figures include orthogonal x, y, and z axis indicators to clarify the plane of the particular view. FIG. 1A shows a prior art Gyrotron 100. An electron gun assembly 102-1 produces an annular electron beam that propagates about axis 102 through input beam tunnel 104 into a cylindrical cavity 105 where electron beam energy is converted to an RF mode with the RF energy propagating helically along the waveguide. High power gyrotrons use transverse electric modes with high radial and azimuthal mode numbers. A typical mode example is $TE_{24,6}$, with this high order mode RF propagating helically along the inner surface of the waveguide in a surface wave mode referred to as a whispering gallery (WG) mode. The RF propagates from the cavity 105 into a waveguide of increasing diameter 106 and into cylindrical waveguide 107 having entrance 127. Because whispering gallery modes cannot be easily transported in waveguide or efficiently used by downstream devices, the whispering gallery mode is typically converted to a quasi-optical mode inside the gyrotron. This is accomplished by radiating the RF power from a step cut launch edge 123 in cylindrical waveguide 107. The radiated wave energy propagates through free space to focusing mirrors 108*a* and 108*b*. Mirrors 108*a* and 108*b* modify the phase and amplitude distribution of the RF wave such that the beam passing through vacuum window 112 of window support 111 is a Gaussian-shaped, quasi-optical, free space wave.

In one example embodiment, waveguide 107 inner surface is modified to shape the waveguide whispering gallery mode such that the RF beam radiated from spiral cut 123 has reduced side lobes with increased power in the central lobe of the RF beam directed toward reflectors 108*a* and 108*b*. Such shaping is accomplished using surface field integral analysis and coupled with advanced optimization routines.

A disadvantage of the device 100 is that additional modifications of the free space output beam 109 are required to couple the RF power into a waveguide for transport to downstream devices, such as an antenna. This is accomplished with a device commonly referred to as a Mirror Optical Unit (MOU) 170, which is coupled to the output beam 109 of the gyrotron 100. The output beam 109 may travel through one or more diamond vacuum-sealing apertures 112 and to phase shaping mirrors 174 and 176, fabricated from high thermal conductivity and high electrical conductivity metals such as copper, which are profiled to shape the large cross section beam diameter (also known as beam waist in the art of free space wave propagation) of the free space Gaussian beam profile 172 to minimize reflections as the free space Gaussian wave transitions to HE11 mode at the waveguide entrance, and one of the objectives of the mirrors is to reduce the free space beam waist before delivery to the entrance of waveguide 186 where the RF beam 178 continues to propagate. Because the gyrotron 100 produces an RF beam with an output beam axis which relies on the angle relationship of many reflective surfaces including launch edge 123, first reflector 108*b* and second reflector 108*a*, the axis of the beam output 109 may vary from device to device. To compensate for these geometric variations, MOU first reflector 174 and MOU second reflector 176 are usually separately adjustable about each mirror's orthogonal mirror axis, which allows adjustment of the beam angle delivered to waveguide 186, and waveguide 186 additionally has a 2-axis translation so that the beam may be centered in the waveguide. The various mirror 174 and 176 angle adjustments (184 and 182, respectively) and output waveguide 186 translation adjustment results in significant setup time and cost, and the adjustment settings may change because of the long beam path and wide mirror spacing as a result of factors such as thermal expansion of structures along this path. A further disadvantage of the gyrotron 100 is that the output window 112 which couples energy out of the gyrotron 100 must be relatively large in diameter due to the radial extend of the Gaussian quasi-optical free wave mode which travels through window 112, which is fabricated using a chemically vapor deposited (CVD) diamond, which has a low RF absorption and high thermal conductivity, which are required for high power (1 MW and above) gyrotrons to prevent damage to the window from thermal energy absorbed from the high power beam. The large diameter Gaussian quasi-optical mode which propagates through window 112 results in a large diameter aperture compared to the reduced diameter output waveguide 186 diameter after conversion to HE11. Additionally, the RF leaving the gyrotron is directed through the spent electron beam 158 to collector 103, where undesirable interactions may occur. Also shown are cathode 113, heater power supply 150, modulated anode 114, modulated anode power supply 152, main power supply 154, and solenoidal magnetic field generator 119, all of which are well known in the art. FIG. 1A has cross section views A-A and B-B, shown in FIGS. 1B and 1C respectively, which shows section views of the structures previously described, including cylindrical waveguide 107, for additional clarity.

Figures 1, 2A, 2B, 2C, 2D:
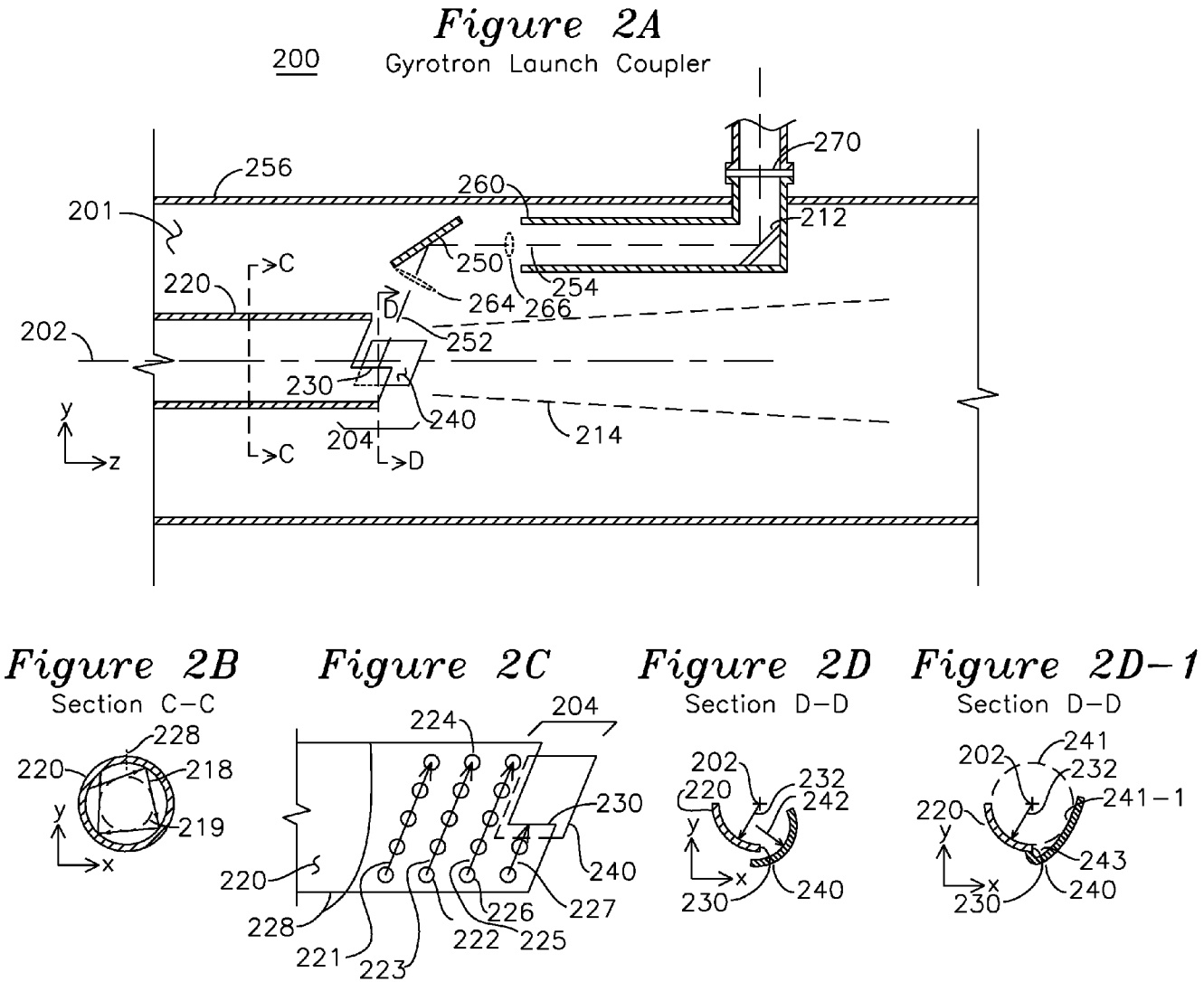

FIG. 2A shows an example embodiment of a gyrotron launch coupler 200 of the present invention which may be used to replace the cylindrical waveguide 107, upper mirror 108*a* and lower mirror 108*b* over axial extent 156 of FIG. 1A, and also the mirror optical unit 170 of FIG. 1A, such that HE11 waves may be coupled into a corrugated waveguide such as 186 of FIG. 1A. Corrugated waveguides are well known in the art for transmission of HE11 wave energy, and an example corrugated waveguide 260 with axis 254 is shown in FIG. 2I, corresponding to the structures of FIG. 2A. Gyrotron enclosure 256 supports internal structures enclosed in vacuum chamber 201 isolated from external pressure by diamond window 270. The gyrotron launch coupler 200 shown in FIG. 2A receives helically propagating WG mode guided RF in waveguide 220, which is launched via launch edge 230 into adjacent first mode conversion mirror 240, which produces an elongated or elliptical Gaussian beam 264 propagating in free space (with extents shown as beam plot 280 of FIG. 2E viewed perpendicular to the local beam axis 281), which is reflected by second mode changing mirror 250, where the free space Gaussian mode wave reduces in beam diameter shown as beam 266 in FIG. 2A with a beam extent perpendicular to beam axis 254 in FIG. 2A, also shown in FIG. 2F having a local beam diameter or beam waist 282), and becomes circularly symmetric about the propagation axis (281 of FIG. 2F and 254 of FIG. 2A) of the beam 266. This free space Gaussian beam is then suitable for direct coupling to corrugated waveguide 260 and RF mirror 212, which results in a greatly reduced beam diameter (beam waist energy extent) and associated diamond window 270 diameter compared to the beam waist energy extent and associated window 112 diameter of FIG. 1A. Spent electron extent 214 remains as shown in FIG. 1A. FIGS. 2D and 2D-1 show section D-D through FIG. 2A for two respective embodiments of the edge launcher.

In the launch coupler of FIG. 2A, RF energy conveyed in an electron beam (not shown) is propagated helically as higher order transverse electric (whispering gallery) RF mode in cylindrical waveguide 220. Cross section C-C of FIG. 2A shows cylindrical waveguide 220 in FIG. 2B including a single "ray tracing" 218 which indicates the individual surface reflections of the quasi-optical helical RF beam 219, as is known in the art of WGM RF propagation. For clarity in understanding the invention, a "split line" 228 is shown in waveguide 220 of FIG. 2B, and if the cylindrical waveguide 220 were split on this line 228 and laid flat, the traveling whispering gallery mode (WGM) waves which propagate across this surface would travel through launch region 204 of FIG. 2A as shown in FIG. 2C, where the continuous helical wave propagation appears as individual linear propagation paths 221, 223, 225, 227 about split line 228. As is clear to those skilled in WGM propagation, a helically propagating wave inside waveguide 220 propagates with a fixed axial velocity, and accordingly, if waveguide 220 were longitudinally cut and unwrapped as shown in FIG. 2C, the single path of helical propagation becomes the continuous path shown as segments 221, 223, 225, 227. Accordingly, each of the propagation paths has associated whispering gallery mode radiation intensity contour patterns along the continuous line of propagation of path 221, path 223, path 225, and path 227, with the RF-field along path 223 shown as contour 222 extending to contour 224, thereafter continuing along path 225 with contour 226, for a succession of wave features representing the surface RF energy intensity of adjacent RF nodes at an instant of time as the propagation paths 221, 223, 225, 227 lead to helical launch edge 230. A first mode-changing reflector 240 is positioned adjacent to helical launch edge 230, and, as shown in FIG. 2A, a second mode-changing reflector 250 is positioned in the propagation path centerline 252 axis as the second reflector 250 reflects energy to corrugated waveguide 260 as HE11 energy along propagation path centerline 254. The positioning of first mode-changing reflector 240 in the range 0.25 wavelengths and 4 wavelengths from helical launch edge 230 is typical, as RF radiated from helical launch edge 230 immediately interacts with first mode changing reflector 240, after which it is directed to second mode changing reflector 250, usually with an elliptical or elongated radiation pattern with the radiation pattern long axis (shown as the x' axis in FIG. 2E) substantially parallel to the propagation paths 221, 223, 225, and 227 and the radiation pattern short axis (shown as y' in FIG. 2E) which is substantially parallel to the helical launch edge 230. Second mode changing reflector 250 has a surface profile selected to reshape the aspect ratio of the incident RF beam from an elliptical or elongated radiation pattern to precisely match the circular electromagnetic field pattern of HE11 supported by corrugated waveguide 260 and having a beam waist which optimally couples into the entrance of corrugated waveguide 260. The RF beam can be efficiently propagated through waveguide 260 and redirected as required by one or more miter bends 212 and through RF vacuum window 270, as shown in FIG. 2A.

Figure 2E:
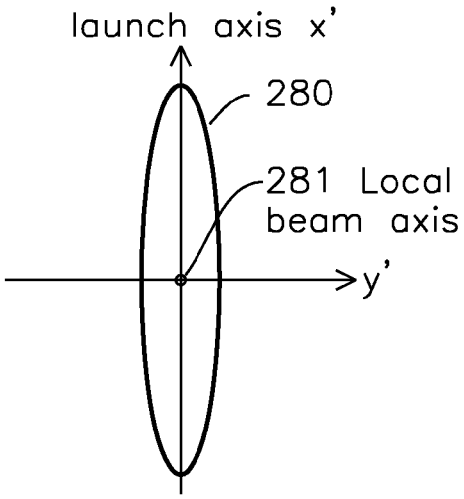
FIGS. 2E and 2F show cross section beam profile plots in a plane orthogonal to the RF beam.

FIG. 2E shows an RF beam profile 280 in an x',y' plane perpendicular to the local beam axis 281 and in the region 264, as shown in FIG. 2A, between the first mode converting reflector 240 and second mode converting reflector 250, the beam profile 264 of FIG. 2A shown closer to the second mode converting reflector 250. The beam profile 280 tends to be elongated or elliptical, and with an aspect ratio on the order of 5:1. FIG. 2G-1 shows the amplitude profile 284 of the RF beam 280 across the y' axis, and FIG. 2G-2 shows the amplitude profile 285 of the RF beam 280 (shown in FIG. 2E) across the x' axis, each of which tend to be a quasi-Gaussian function across their respective axis. The dependent axis of each of FIGS. 2G-1, 2G-2 and 2H are labeled |A| to indicate absolute value of amplitude for clarity in understanding the invention.

Figure 2F:
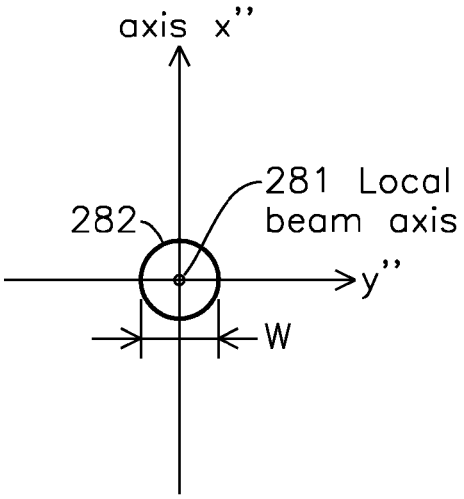
Figures 1, 2G:
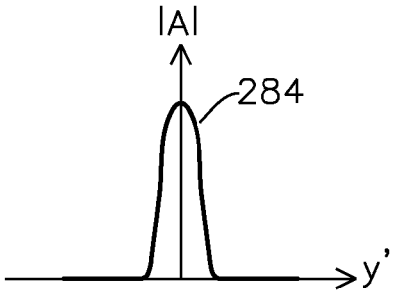
Figure 2H:
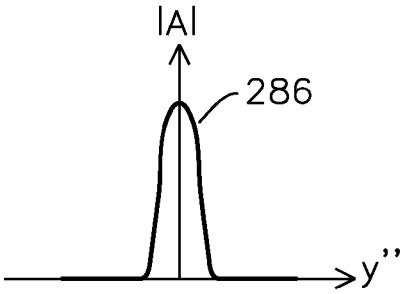
FIG. 2H shows the beam amplitude profile for plot 2F.
Figures 2, 2G:
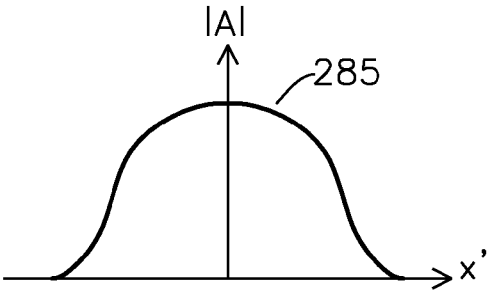
Figure 2I:
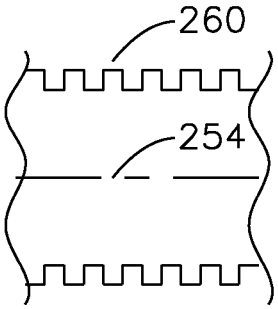
FIG. 2I shows a corrugated waveguide.

FIG. 2F shows the RF beam profile in the plane x",y" perpendicular to the RF beam axis at the output of the second mode converting reflector. The second beam reflector 250 corrects for the incoming elliptical beam profile shown in FIG. 2E, and generates a substantially circularly symmetric radiation pattern 282 with a beam profile 286 as shown in FIG. 2H. The RF beam profile which exits second mode converting reflector 250 tends to have a beam profile 282, or beam waist W, which has a minimum waist diameter, and the location of the beam waist minimum is the preferred location for the entry of the beam into corrugated waveguide 260.

Because of the reduced radial extent of the RF beam within the HE11 waveguide, RF window 270 shown in FIG. 2A can have a significantly smaller diameter than would be required for a free space quasi-optical Gaussian mode beam 109 of FIG. 1A. Moving the RF window to a region near the HE11 waveguide allows the diameter of the RF window to reduce to the diameter of the MOU output waveguide 186. Additionally, since the gyrotron of FIG. 2A has greatly reduced path lengths between reflective surfaces and the structures are closely associated compared to the gyrotron of FIG. 1A, it is not necessary to perform the beam alignment associated with adjustable mirrors, as the HE11 beam can be directly coupled into output corrugated waveguide 260. This results in significant cost reduction through the reduced number of structures, reduced exit window 270 diameter, and elimination of the MOU 170 alignment requirements compared to the device of FIG. 1A. In one example of the invention shown in FIG. 2D-1, the cylindrical waveguide 220, launch edge 230, first mode converting reflector 240, and second mode converting reflector 250 of FIG. 2A are formed from a single heterogeneous material such as copper, so there are no mechanical interfaces or joints to change the alignment.

In one example of the invention, the device operates at a frequency of 110 GHz, waveguide 220 has a radius 232 (of FIG. 2D) of 20.5 mm, and the first reflector 240 has a circular cross section with a radius 242 less than 20.5 mm, and an axial extent approximately equal to the axial extent of the launch edge 230, which is computed from the wave number of the propagating RF in WG mode. The included angle of the first reflector 240 about its center of radius is approximately 90 degrees, or one quarter of the circular waveguide 220, although this can range from 30 degrees to 120 degrees. Second reflector 250 has an angle with respect to the axis 202 which is selected to re-direct the RF propagating on axis 254 to be parallel to the axis 202 of FIG. 2A, although this angle can be selected based on the preferred exit angle for RF coupling into the corrugated output waveguide 260.

Many example embodiments are possible for the surface shape of waveguide surface 220, first mode changing reflector 240, and second mode changing reflector 250. In one embodiment of the invention, the cylindrical waveguide 220, first mode changing reflector 240, and second mode changing reflector 250 have surface shapes and profiles which are optimized by using surface integral field analysis, including finite element analysis software coupled with advanced electromagnetic field optimization software.

In another embodiment of the invention shown in FIG. 2D-1, the first reflector 240 is shown with respect to launch edge 230, and the first reflector 240 is integral with cylindrical waveguide (shown as dashed outline 241) and includes a discontinuous region 243 where first reflector 240 has a surface which is generally radial and perpendicular in region 243 and also adjacent to launch edge 230. The first reflector 240 has a region 241-1 which is optionally tangent to the projected diameter of input waveguide 241 (shown as dashed line), and in one embodiment of the invention, the first reflector 240 includes active surfaces which are adjacent to launch edge 230 and which are within a quarter wavelength to 4 wavelengths of the WG RF propagating within input waveguide 241.

Internal to cylindrical waveguide 220 are a series of deformations that convert the mode incident from the gyrotron to a Gaussian like beam. In one example embodiment of the invention, cylindrical waveguide 220 has surface deformations which generate enhanced currents which provide a semi-Gaussian beam which is not circularly symmetric in radiation pattern, but one which has an intensity profile with an elliptical intensity cross section as previously described, and with an initially long axis parallel to the arc formed by a radial line which is perpendicular to the center axis 202 and swept along helical path 221, 223, 224, 227, shaped principally by reflector 240 of FIGS. 2A, 2C, and 2D. The long axis x' (parallel to path 223, 225, 227 of FIG. 2C) of the radiation pattern is focused by reflector 240 of FIGS. 2A, 2C, 2D, and 2D-1 such that the long axis x' extent reduces along path 252 of FIG. 2A and reaches a minimum extent at the entrance to corrugated waveguide 260, optionally also shaped and focused for x' extent along the propagation path 252 by second reflector 250. Second reflector 250 may also provide surface shaping to reduce the beam extent in the short axis y' of the radiation pattern (parallel to launch edge 230) until it similarly reaches a minimum extent at the entrance to corrugated waveguide, with the radiation at the entrance to corrugated waveguide 260 preferably achieving a substantially circular cross section radiation pattern. The profiles of first reflector 240 of FIGS. 2A, 2C, 2D, and 2D-1 and second reflector 250 of FIG. 2A are selected to provide maximum coupling efficiency for the free space quasi-Gaussian RF into the waveguide 160. The elliptical quasi-Gaussian output beam containing high order modes is thereby focused and shaped into a substantially circular cross section suitable for free-space coupling into the circular corrugated waveguide 260 which supports HE11 mode, thereby minimizing coupling losses at the free-space wave to corrugated waveguide interface. For the purposes of this invention, "substantially circular" may be defined to be a shape which has a short axis dimension which is within 20% of a long axis dimension. For example, if the long axis of radiation pattern 282 of FIG. 2F is 20 mm and the short axis of this radiation pattern is in the range 16 mm to 20 mm, this radiation pattern may be considered "substantially circular".

In another example embodiment, the first reflector and mode converter 240 are integrated into the circular waveguide 220 launcher 230 to directly generate a circular RF beam cross section from the launcher 230 onto propagation path 252.

Second mode converting reflector 250 may be placed within the inner circumference of the tube envelope 256 to match the beam waist radiated from the launcher to the HE11 mode in the corrugated guide. This reflector 250 can also be used to tilt the output beam angle to be parallel to the tube axis 202.

In one embodiment of the invention, the cylindrical waveguide 220 has internal depressions on the inner waveguide surface which maximize the generation of quasi-Gaussian mode free space waves. The internal depressions on the inner waveguide cause the generation of "high order TE modes", which is defined in the present invention as any TE mode with an azimuthal mode greater than 15, such that for TEmn, m>15. In another embodiment of the invention, the first reflector such as 240 provides a surface with an azimuthal radius of curvature which is less than the radius of curvature of the central waveguide 220 to reduce the transverse extent of the coupled RF energy from launcher 230.

Figure 3A:
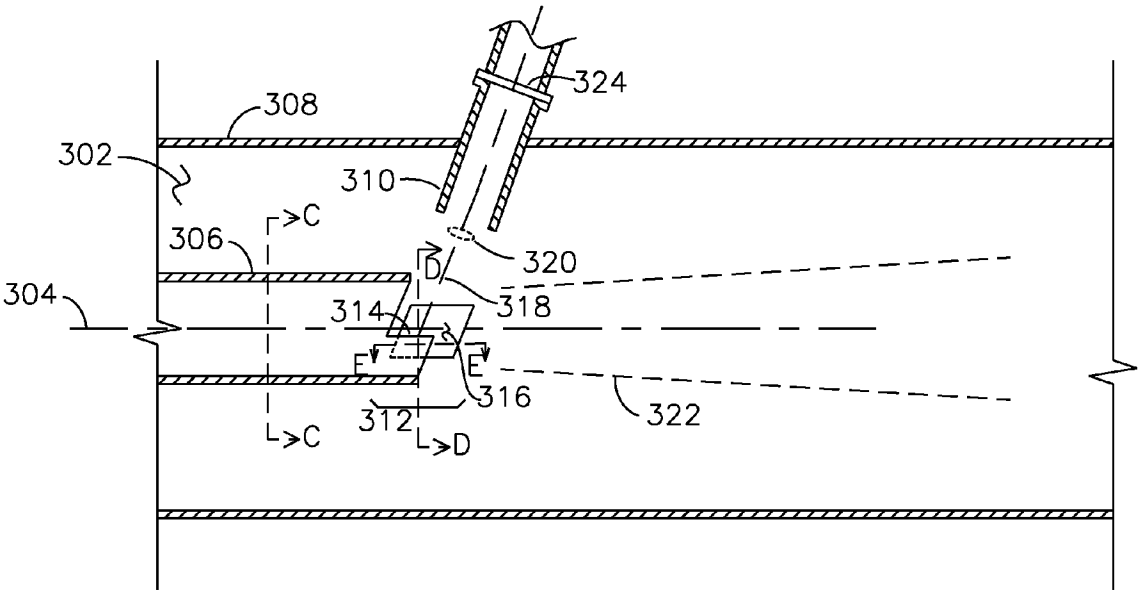
FIG. 3A shows a cross section view of a gyrotron with a single beam shaping mirror.
Figure 3C:
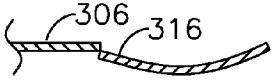
FIGS. 3B and 3C show section views D-D and E-E, respectively, of the beam shaping reflector of FIG. 3A.
Figure 3B:
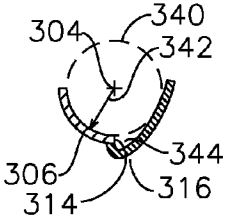

FIG. 3A, which may be viewed in combination with section D-D shown in FIG. 3B and section E-E shown in FIG. 3C, shows an embodiment 300 of the invention having a single reflector 316 where the cylindrical waveguide 306 and launch edge 314 provide RF energy to a reflector 316 which is similarly spaced (as in the structure of FIG. 2A) between a quarter wavelength and four wavelengths from launch edge 314, and which provides beam focusing and mode conversion to generate a circularly symmetric radiation pattern 320 on the RF beam propagation axis 318 and at the entrance to the corrugated waveguide 310. FIG. 3A also shows the spent electron beam 322 which, as in FIG. 2A, is minimally interacting with the free space RF (in contrast with FIG. 1A where the RF traverses through the spent RF beam 158 multiple times), enclosure 308 with evacuated chamber 302, central axis 304, launch region 312, and aperture window 324 for preserving the vacuum of the gyrotron 300. FIG. 3A section C-C is identical to the previously described section C-C of FIG. 2B, and FIG. 3A section D-D is shown in FIG. 3B, where the waveguide 306 is formed into a launch edge 314 which surfaces are separated by gap 344 to nearby single dual-purpose reflector 316, which performs the corrections described for reflectors 240 and 250 of FIG. 2A, which results in a symmetric minimum waist beam of the free space RF which is provided at the entrance corrugated waveguide 310, which efficiently accepts the free space RF energy and transports HE11 mode through the corrugated waveguides and through RF transparent vacuum seal window 324. The additional axial focusing of dual purpose reflector 316 may be seen with the edge relationship to reflector 306 in FIG. 3C showing section E-E of FIG. 3A. Additionally, radius 342 and reference circle 340 of FIG. 3B identify analogous respective elements as FIG. 2D-1 radius 232 and with reference circle 241 which indicates in dashed line reference the extent of input waveguide 220.

The coupling efficiencies of the free space quasi-gaussian RF coupling into the entrance of the corrugated waveguide, as shown in FIGS. 2A and 3A, provides for very efficient coupling and minimal reflection loss. The coupling efficiency into the corrugated waveguide for the devices of FIGS. 2A and 3A exceeds 95%, and is typically 98% or more.

Because of the close proximity of the components of the invention, as in FIG. 2A, any of the structures of FIG. 3A may be formed as a single unit, including any subset or set of: waveguide 306, launch edge 314, reflector 316, and a support (not shown) for the corrugated waveguide 310. The fabrication of these components from a homogeneous slab of material such as copper can eliminate the need for mechanical adjustments of the prior art, and can also include corrective structures which minimize or eliminate mechanical deformations caused by thermal gradients in the gyrotron coupling structures.

I claim:

1. A coupler for a gyrotron, the coupler having:

a cylindrical waveguide for helically propagating Whispering Gallery (WG) mode Radio Frequency (RF) energy, the cylindrical waveguide terminating in a launch edge;

a first mode converting reflector adjacent to said launch edge and reflecting said WG mode RF energy from said launch edge into free space quasi-Gaussian mode RF energy having an elongate amplitude profile;

a second mode converting reflector receiving said free space quasi-Gaussian mode RF energy and having a reflection surface which generates a circularly symmetric free space quasi-Gaussian mode RF energy distribution at a distance D from said second mode converting reflector;

a corrugated waveguide located at said distance D from said second mode converting reflector and receiving said circularly symmetric free space quasi-Gaussian mode RF energy distribution for propagation in said corrugated waveguide in an HE11 mode.

2. The coupler of claim 1 where said first reflector is a distance of from 0.25 to 4 wavelengths of said WG mode RF energy from said launch edge.

3. The coupler of claim 1 where said cylindrical waveguide contains axial depressions and azimuthal depressions which enhance the generation of a TE24,6 mode.

4. The coupler of claim 1 where said cylindrical waveguide, said launch edge, and said first mode converting reflector are formed on a single piece of metal.

5. The coupler of claim 4 where said metal is copper.

6. The coupler of claim 1 where said corrugated waveguide includes a miter bend and a vacuum aperture.

7. The coupler of claim 6 where said vacuum aperture has a diamond window.

8. A coupler for a gyrotron, the coupler having:

a cylindrical waveguide for Whispering Gallery (WG) mode Radio Frequency (RF) energy, the cylindrical waveguide having a launch edge for said Whispering Gallery Radio Frequency energy;

said launch edge coupled to a first mode converting reflector for accepting WG mode RF energy radiated from said launch edge and generating a quasi-Gaussian free-space wave having an elongate amplitude profile;

a second mode converting reflector accepting said elongate amplitude profile quasi-Gaussian free space wave and converting the elongate amplitude profile of said quasi-Gaussian free-space wave into a substantially circular amplitude profile, said substantially circular amplitude profile also occurring in a region where said circular amplitude profile also has a minimum beam waist diameter;

a corrugated waveguide having an aperture positioned in said region of minimum beam waist diameter and coupling said quasi-Gaussian free-space wave as a guided wave with a HE11 mode;

where said cylindrical waveguide, said launch edge, said first mode converting reflector, and said second mode converting reflector are a single structure.

9. The coupler of claim 8 where said first mode converting reflector is from 0.25 wavelengths to 4 wavelengths of said WG mode RF energy from said launch edge.

10. The coupler of claim 8 where said elongate amplitude profile is perpendicular to a local beam axis.

11. The coupler of claim 8 where said substantially circular amplitude profile is with respect to a local beam axis.

12. The coupler of claim 8 where said second mode converting reflector reduces an elongate extent of said elongate amplitude profile perpendicular to a local beam axis.

13. The coupler of claim 12 where said corrugated waveguide has an axis which is substantially the same as said local beam axis.

14. The coupler of claim 8 where said cylindrical waveguide includes axial and azimuthal depressions for the enhanced generation of high order quasi-Gaussian modes including a $TE_{24,6}$ mode.

15. The coupler of claim 8 where said single structure is copper.

16. A coupler for whispering gallery mode RF travelling helically in a cylindrical input waveguide, the coupler having:

a launch edge in said waveguide for launching RF energy;

a reflection surface adjacent to said launch edge and receiving said RF energy, said reflection surface having a first curvature in an RF propagation axis and a second curvature perpendicular to said RF propagation axis, said first curvature and said second curvature forming said RF energy into a substantially circularly symmetric free-space RF beam which includes high order TE modes, said RF beam converging to a region having a minimum RF beam diameter;

a corrugated waveguide positioned in said region of minimum RF beam diameter and carrying said RF energy from said free-space RF beam in an $HE_{11}$ mode.

17. The coupler of claim 16 where said reflection surface accepts said RF energy from said launch edge and generates said substantially circularly symmetric free space RF beam at the entrance of said corrugated waveguide.

18. The coupler of claim 16 where said cylindrical input waveguide has an inner surface which includes irregularities for the generation of a $TE_{24,6}$ mode in said RF beam.

19. The coupler of claim 16 where said input waveguide, said launch edge, and said reflection surface are formed from the same structure.

* * * * *